US010446108B2

(12) United States Patent
Shin et al.

(10) Patent No.: US 10,446,108 B2
(45) Date of Patent: Oct. 15, 2019

(54) DISPLAY APPARATUS AND METHOD

(71) Applicant: SAMSUNG DISPLAY CO., LTD., Yongin-si, Gyeonggi-do (KR)

(72) Inventors: Dong-Hwa Shin, Yongin-si (KR); Jung-Won Kim, Seoul (KR); Jae-Sung Bae, Suwon-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 538 days.

(21) Appl. No.: 15/054,674

(22) Filed: Feb. 26, 2016

(65) Prior Publication Data

US 2017/0039980 A1 Feb. 9, 2017

(30) Foreign Application Priority Data

Aug. 6, 2015 (KR) ..... 10-2015-0111116

(51) Int. Cl.
*G09G 3/36* (2006.01)

(52) U.S. Cl.
CPC ..... *G09G 3/3696* (2013.01); *G09G 3/3614* (2013.01); *G09G 3/3648* (2013.01); *G09G 3/3685* (2013.01); *G09G 2320/0673* (2013.01)

(58) Field of Classification Search
None
See application file for complete search history.

(56) References Cited

U.S. PATENT DOCUMENTS

2008/0088559 A1* 4/2008 Lai ..... G09G 3/3648 345/89
2010/0013803 A1* 1/2010 Noguchi ..... G02F 1/136286 345/204
2010/0315402 A1* 12/2010 Hashimoto ..... G09G 3/3614 345/211
2015/0192812 A1 7/2015 Hwang et al.

* cited by examiner

*Primary Examiner* — Amare Mengistu
*Assistant Examiner* — Sarvesh J Nadkarni
(74) *Attorney, Agent, or Firm* — F. Chau & Associates, LLC

(57) ABSTRACT

A display apparatus includes a display panel, a timing controller and a data driver. The display panel includes a first gate line, first and second pixels connected to the first gate line and adjacent to the first gate line in a first direction, and third and fourth pixels connected to the first gate line and adjacent to the first gate line in a second direction substantially opposite to the first direction. The timing controller is configured to generate a data signal based on a first gamma and a second gamma different from the first gamma. The data driver is configured to output a first data voltage to the first pixel in a first frame, a second data voltage to the first pixel in a second frame, a third data voltage to the second pixel in the first frame, a fourth data voltage to the third pixel in the first frame, and a fifth data voltage to the fourth pixel in the first frame based on the data signal, the first and fourth data voltages having a first polarity, the third and fifth data voltages having a second polarity different from the first polarity, the first and fifth data voltages being generated based on the first gamma, the second through fourth data voltages being generated based on the second gamma.

12 Claims, 13 Drawing Sheets

DISPLAY APPARATUS AND METHOD

CROSS-REFERENCE TO RELATED APPLICATION

This application claims priority under 35 U.S.C. § 119 to Korean Patent Application No. 10-2015-0111116, filed on Aug. 6, 2015 in the Korean Intellectual Property Office (KIPO), the contents of which are herein incorporated by reference in their entireties.

TECHNICAL FIELD

Exemplary embodiments of the present inventive concept relate generally to display devices, and more particularly to display apparatuses and methods of driving the display apparatuses.

DISCUSSION OF RELATED ART

A liquid crystal display (LCD) apparatus may include a first substrate including a pixel electrode, a second substrate including a common electrode, and a liquid crystal layer disposed between the first and second substrates. Voltages may be applied to the pixel electrode and the common electrode to generate an electric field. Transmittance of light passing through the liquid crystal layer may be controlled according to the electric field, and thus, a desired image may be displayed.

To enhance visibility of the LCD apparatus, a temporal gamma mixing (TGM) scheme may be employed that establishes one frame set based on at least two frames and displays an original image during one frame set by combining at least one frame image having a grayscale higher than that of the original image during at least one frame and at least one frame image having a grayscale lower than that of the original image during at least one frame. A moving artifact and/or a flicker may appear on the LCD apparatus operating based on the TGM scheme.

SUMMARY

An exemplary embodiment of the present inventive concept provides a display apparatus capable of high display quality.

An exemplary embodiment of the present inventive concept provides a method of driving the display apparatus.

A display apparatus according to an exemplary embodiment of the present inventive concept includes a display panel, a timing controller and a data driver. The display panel includes a first gate line, first and second pixels connected to the first gate line and disposed adjacent to the first gate line in a first direction, and third and fourth pixels connected to the first gate line and disposed adjacent to the first gate line in a second direction substantially opposite to the first direction. The timing controller is configured to generate a data signal based on a first gamma and a second gamma different from the first gamma. The data driver is configured to output a first data voltage to the first pixel in a first frame, a second data voltage to the first pixel in a second frame, a third data voltage to the second pixel in the first frame, a fourth data voltage to the third pixel in the first frame, and a fifth data voltage to the fourth pixel in the first frame based on the data signal, the first and fourth data voltages having a first polarity, the third and fifth data voltages having a second polarity different from the first polarity, the first and fifth data voltages being generated based on the first gamma, the second through fourth data voltages being generated based on the second gamma.

In an exemplary embodiment, the second pixel may be adjacent to the first pixel, and the fourth pixel may be adjacent to the third pixel.

In an exemplary embodiment, the second pixel may be adjacent to the first pixel in a third direction crossing the first and second directions, and the fourth pixel may be adjacent to the third pixel in the third direction.

In an exemplary embodiment, a luminance of an image based on the first gamma may be equal to or higher than a luminance of an image based on the second gamma.

In an exemplary embodiment, the luminance of the image based on the first gamma may be equal to or higher than a luminance of an image based on a reference gamma, and the luminance of the image based on the second gamma may be equal to or lower than the luminance of the image based on the reference gamma.

In an exemplary embodiment, the display panel may further include a second gate line, fifth and sixth pixels connected to the second gate line and adjacent to the second gate line in the first direction, and seventh and eighth pixels connected to the second gate line and adjacent to the second gate line in the second direction. When the fifth and sixth pixels display a first image pattern in the first frame and the seventh and eighth pixels display a second image pattern different from the first image pattern in the first frame, the data signal may be configured to be generated based on the first gamma, the second gamma and the reference gamma, and the data driver may be configured to output sixth and seventh data voltages to the fifth and sixth pixels respectively in the first frame based on the data signal, the sixth and seventh data voltages being generated based on the reference gamma.

In an exemplary embodiment, the display panel may further include a second gate line, fifth and sixth pixels connected to the second gate line and adjacent to the second gate line in the first direction, and seventh and eighth pixels connected to the second gate line and adjacent to the second gate line in the second direction. When the fifth and sixth pixels display a first image pattern in the first and second frames and the seventh and eighth pixels display a second image pattern different from the first image pattern in the first and second frames, the data driver may be configured to output sixth and seventh data voltages to the fifth and sixth pixels respectively in the first frame and eighth and ninth data voltages to the fifth and sixth pixels respectively in the second frame based on the data signal, the sixth and seventh data voltages being generated based on the first gamma, the eighth and ninth data voltages being generated based on the second gamma.

In an exemplary embodiment, the display panel may further include ninth and tenth pixels connected to the second gate line and adjacent to the second gate line in the first direction, and eleventh and twelfth pixels connected to the second gate line and adjacent to the second gate line in the second direction. When the ninth and tenth pixels display the first image pattern in the first frame and the eleventh and twelfth pixels display the second image pattern in the first frame, the data driver may be configured to output tenth and eleventh data voltages to the ninth and tenth pixels respectively in the first frame based on the data signal, the tenth and eleventh data voltages being generated based on the first gamma.

In an exemplary embodiment, the display panel may further include ninth and tenth pixels connected to the second gate line and adjacent to the second gate line in the first direction, and eleventh and twelfth pixels connected to the second gate line and adjacent to the second gate line in the second direction. When the ninth and tenth pixels display the first image pattern in the first frame and the eleventh and twelfth pixels display the second image pattern in the first frame, the data driver may be configured to output tenth and eleventh data voltages to the ninth and tenth pixels respectively in the first frame based on the data signal, the tenth and eleventh data voltages being generated based on the second gamma.

In an exemplary embodiment, the data driver may be configured to output sixth and seventh data voltages to the second and third pixels respectively in the second frame and eighth data voltage to the fourth pixel in the second frame, the sixth and seventh data voltages being generated based on the first gamma, the eighth data voltage being generated based on the second gamma.

A display apparatus according to an exemplary embodiment of the present inventive concept includes a display panel, a timing controller and a data driver. The display panel includes a first gate line, first and second pixels connected to the first gate line and adjacent to the first gate line in a first direction, and third and fourth pixels connected to the first gate line and adjacent to the first gate line in a second direction substantially opposite to the first direction. The timing controller is configured to generate a data signal based on a first gamma and a second gamma different from the first gamma. The data driver is configured to output a first data voltage to the first pixel in a first frame, a second data voltage to the first pixel in a second frame, a third data voltage to the second pixel in the first frame, a fourth data voltage to the third pixel in the first frame, and a fifth data voltage to the fourth pixel in the first frame based on the data signal, the first and third data voltages having a first polarity, the fourth and fifth data voltages having a second polarity different from the first polarity, the first and fifth data voltages being generated based on the first gamma, the second through fourth data voltages being generated based on the second gamma.

In an exemplary embodiment, a luminance of an image based on the first gamma may be equal to or higher than a luminance of an image based on a reference gamma, and a luminance of an image based on the second gamma may be equal to or lower than the luminance of the image based on the reference gamma.

A method of driving a display apparatus including a display panel including a first gate line, first and second pixels connected to the first gate line and adjacent to the first gate line in a first direction, and third and fourth pixels connected to the first gate line and adjacent to the first gate line in a second direction substantially opposite to the first direction according to an exemplary embodiment of the present inventive concept includes outputting a first data voltage to the first pixel in a first frame, the first data voltage being generated based on a first gamma and having a first polarity, outputting a second data voltage to the first pixel in a second frame, the second data voltage being generated based on a second gamma different from the first gamma, outputting a third data voltage to the second pixel in the first frame, the third data voltage being generated based on the second gamma and having a second polarity different from the first polarity, outputting a fourth data voltage to the third pixel in the first frame, the fourth data voltage being generated based on the second gamma and having the first polarity, and outputting a fifth data voltage to the fourth pixel in the first frame, the fifth data voltage being generated based on the first gamma and having the second polarity.

In an exemplary embodiment, a luminance of an image based on the first gamma may be equal to or higher than a luminance of an image based on the second gamma.

In an exemplary embodiment, the luminance of the image based on the first gamma may be equal to or higher than a luminance of an image based on a reference gamma, and the luminance of the image based on the second gamma may be equal to or lower than the luminance of the image based on the reference gamma.

In an exemplary embodiment, the display panel may further include a second gate line, fifth and sixth pixels connected to the second gate line and adjacent to the second gate line in the first direction, and seventh and eighth pixels connected to the second gate line and adjacent to the second gate line in the second direction. When the fifth and sixth pixels display a first image pattern in the first frame and the seventh and eighth pixels display a second image pattern different from the first image pattern in the first frame, the method may further include outputting sixth and seventh data voltages to the fifth and sixth pixels respectively in the first frame, the sixth and seventh data voltages being generated based on the reference gamma.

In an exemplary embodiment, the display panel may further include a second gate line, fifth and sixth pixels connected to the second gate line and adjacent to the second gate line in the first direction, and seventh and eighth pixels connected to the second gate line and adjacent to the second gate line in the second direction. When the fifth and sixth pixels display a first image pattern in the first and second frames and the seventh and eighth pixels display a second image pattern different from the first image pattern in the first and second frames, the method may further includes outputting sixth and seventh data voltages to the fifth and sixth pixels respectively in the first frame, the sixth and seventh data voltages being generated based on the first gamma, and outputting eighth and ninth data voltages to the fifth and sixth pixels respectively in the second frame, the eighth and ninth data voltages being generated based on the second gamma.

In an exemplary embodiment, the display panel may further include ninth and tenth pixels connected to the second gate line and adjacent to the second gate line in the first direction, and eleventh and twelfth pixels connected to the second gate line and adjacent to the second gate line in the second direction. When the ninth and tenth pixels display the first image pattern in the first frame and the eleventh and twelfth pixels display the second image pattern in the first frame, the method may further include outputting tenth and eleventh data voltages to the ninth and tenth pixels respectively in the first frame, the tenth and eleventh data voltages being generated based on the first gamma.

In an exemplary embodiment, the display panel may further include ninth and tenth pixels connected to the second gate line and adjacent to the second gate line in the first direction, and eleventh and twelfth pixels connected to the second gate line and adjacent to the second gate line in the second direction. When the ninth and tenth pixels display the first image pattern in the first frame and the eleventh and twelfth pixels display the second image pattern in the first frame, the method may further include outputting tenth and eleventh data voltages to the ninth and tenth pixels respectively in the first frame, the tenth and eleventh data voltages being generated based on the second gamma.

In an exemplary embodiment, the method may further include outputting a sixth data voltage to the second pixel in the second frame, the sixth data voltage being generated based on the first gamma, outputting a seventh data voltage to the third pixel in the second frame, the seventh data voltage being generated based on the first gamma, and outputting a eighth data voltage to the fourth pixel in the second frame, the eighth data voltage being generated based on the second gamma.

An exemplary embodiment method of driving a display panel is provided where the panel has a first plurality of gate lines, a second plurality of data lines, and a third plurality of pixels, each of the third plurality of pixels connected to one of the first plurality of gate lines and one of the second plurality of data lines, wherein a fourth plurality of alternating groups each comprising a fifth plurality of pixels are connected on alternating sides of the gate lines, respectively, the method including driving at least one pixel of each alternating group with a data value based on a first gamma different than at least a second gamma for at least another pixel of that group.

An exemplary embodiment method may provide that the fifth plurality is two pixels per group.

An exemplary embodiment method may provide that the first and second gamma are substantially a same amount higher and lower than an original gamma, respectively.

An exemplary embodiment method may provide that the data values for the fifth plurality of pixels per group are each based on a fifth plurality of gamma, respectively.

An exemplary embodiment method may provide that an average of the fifth plurality of gamma for a current frame is substantially equal to an original gamma.

An exemplary embodiment method may provide that an average of the fifth plurality of gamma over a sixth plurality of alternating image frames is substantially equal to an original gamma.

An exemplary embodiment method may provide that an order of gamma within each alternating group is the reverse order of gamma within the next alternating group.

An exemplary embodiment method may provide that an order of gamma for each alternating group is reversed between each of a sixth plurality of alternating image frames.

An exemplary embodiment method may further include driving pixels disposed in a single row, and each connected to one of a first gate line or a second gate line, with data values based on a substantially black gamma.

An exemplary embodiment method may further include driving at least one pixel of each alternating group with a different polarity than at least another pixel of that alternating group.

An exemplary embodiment method may further include driving all pixels of at least one alternating group with a different polarity than all pixels of another alternating group.

An exemplary embodiment method may further include driving each of the third plurality of pixels with data values having a first set of polarities in a first frame, and driving each of the third plurality of pixels with data values having a second set of polarities in a next frame, wherein the first and second sets of polarities are substantially opposite.

According to an exemplary embodiment, moving artifact and flicker caused by a temporal gamma mixing ("TGM") method may be substantially minimized, and horizontal cross-talk appearing at edges of image patterns may be substantially avoided. Thus, high display quality of the display panel can be achieved.

BRIEF DESCRIPTION OF THE DRAWINGS

The above and other features of the present inventive concept will become more apparent by describing in detail exemplary embodiments thereof with reference to the accompanying drawings, in which.

DETAILED DESCRIPTION

Hereinafter, the present inventive concept will be explained in detail with reference to the accompanying drawings. As used herein, the term "gamma" may be used to refer to gamma curves, gamma bases, gamma values or the like usable to adjust image grayscale values, such as per a logarithmic gamma curve like that defined for the sRGB color profile (close to the approximation y=x^2.224). For example, the gamma curve for the sRGB color profile defines how raw light intensity values may be converted into image data values, and vise-versa. Other gamma curves may be used to apply an arbitrary curve function to adjust the luminance values for an output image, typically when the curve approximates a logarithmic function, but it is not limited thereto. Gamma may be used to adjust the basis for some or all luminance values throughout an image frame or sub-frame, without limitation. Gamma may adjust the lightness or darkness of mid-tones while keeping the black point and the white point the same, for example, but it is not limited thereto.

Figure 1:
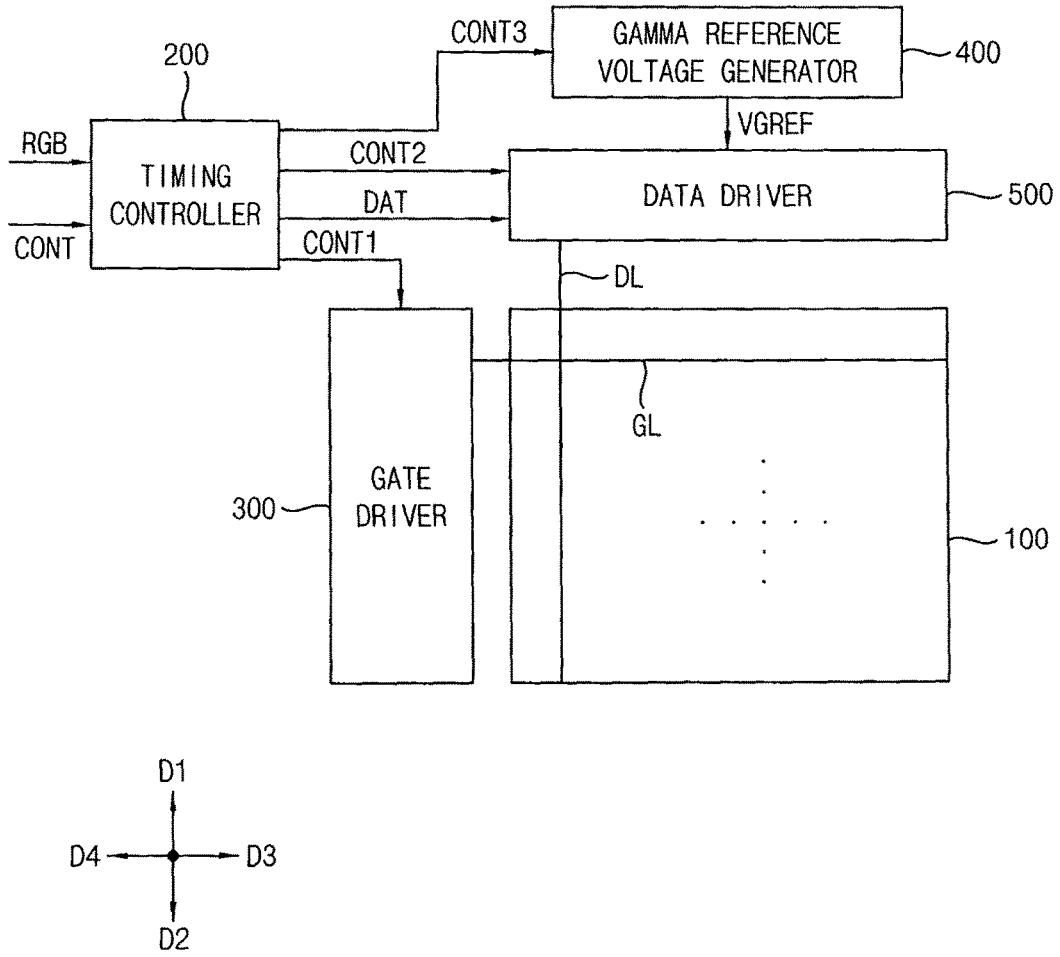
FIG. 1 is a schematic block diagram illustrating a display apparatus according to an exemplary embodiment.

FIG. 1 is a block diagram illustrating a display apparatus according to an exemplary embodiment.

Referring to FIG. 1, the display apparatus includes a display panel 100 connected to a panel driver. The panel driver includes a timing controller 200, a gate driver 300 connected between the timing controller and a gate line GL of the display panel, a gamma reference voltage generator 400 connected to the timing controller, and a data driver 500 connected to the gamma reference voltage generator and connected between the timing controller and a data line DL of the display panel.

The display panel 100 includes a display region for displaying an image and a peripheral region adjacent to the display region.

The display panel 100 includes a plurality of gate lines GL, a plurality of data lines DL and a plurality of pixels connected to the gate lines GL and the data lines DL. The data lines DL extend in a first direction D1 or a second direction D2 substantially opposite to the first direction D1 and the gate lines GL extend in a third direction D3 crossing the first direction D1 or a fourth direction D4 substantially opposite to the third direction D3.

In an exemplary embodiment, the pixels may include a switching element (not shown), a liquid crystal capacitor (not shown) and a storage capacitor (not shown). The liquid crystal capacitor and the storage capacitor may be electrically connected to the switching element. The pixels may be arranged in a matrix configuration.

The display panel 100 will be explained in detail with reference to FIGS. 2A through 2D, 3A, 3B, 4A, 4B, 5A, 5B, 6A and 6B.

The timing controller 200 receives input image data RGB and an input control signal CONT from an external device (not shown). The input image data RGB may include red image data R, green image data G and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3 and a data signal DAT based on the input image data RGB and the input control signal CONT.

The timing controller 200 generates the first control signal CONT1 for controlling operations of the gate driver 300 based on the input control signal CONT, and outputs the first control signal CONT1 to the gate driver 300. The first control signal CONT1 may include a vertical start signal and a gate clock signal.

The timing controller 200 generates the second control signal CONT2 for controlling operations of the data driver 500 based on the input control signal CONT, and outputs the second control signal CONT2 to the data driver 500. The second control signal CONT2 may include a horizontal start signal and a load signal.

The timing controller 200 generates the data signal DAT based on the input image data RGB. The timing controller 200 outputs the data signal DAT to the data driver 500.

The timing controller 200 generates the third control signal CONT3 for controlling operations of the gamma reference voltage generator 400 based on the input control signal CONT, and outputs the third control signal CONT3 to the gamma reference voltage generator 400.

The gate driver 300 generates gate signals for driving the gate lines GL in response to the first control signal CONT1 received from the timing controller 200. The gate driver 300 sequentially outputs the gate signals to the gate lines GL.

In an exemplary embodiment, the gate driver 300 may be directly mounted on the display panel 100, or may be connected to the display panel 100 as a tape carrier package (TCP) type. Alternatively, the gate driver 300 may be integrated on the peripheral region of the display panel 100.

The gamma reference voltage generator 400 generates a gamma reference voltage VGREF in response to the third control signal CONT3 received from the timing controller 200. The gamma reference voltage generator 400 outputs the gamma reference voltage VGREF to the data driver 500. The level of the gamma reference voltage VGREF corresponds to grayscales of a plurality of pixel data included in the data signal DAT.

In an exemplary embodiment, the gamma reference voltage generator 400 may be disposed in the timing controller 200, or may be disposed in the data driver 500.

The data driver 500 receives the second control signal CONT2 and the data signal DAT from the timing controller 200, and receives the gamma reference voltage VGREF from the gamma reference voltage generator 400. The data driver 500 converts the data signal DAT to data voltages having analogue levels based on the gamma reference voltage VGREF. The data driver 500 outputs the data voltages to the data lines DL.

In an exemplary embodiment, the data driver 500 may be directly mounted on the display panel 100, or may be connected to the display panel 100 as a tape carrier package (TCP) type. Alternatively, the data driver 500 may be integrated on the peripheral region of the display panel 100.

The data driver 500 will be explained in detail with reference to FIGS. 2A through 2D, 3A, 3B, 4A, 4B, 5A, 5B, 6A and 6B.

Figure 2A:
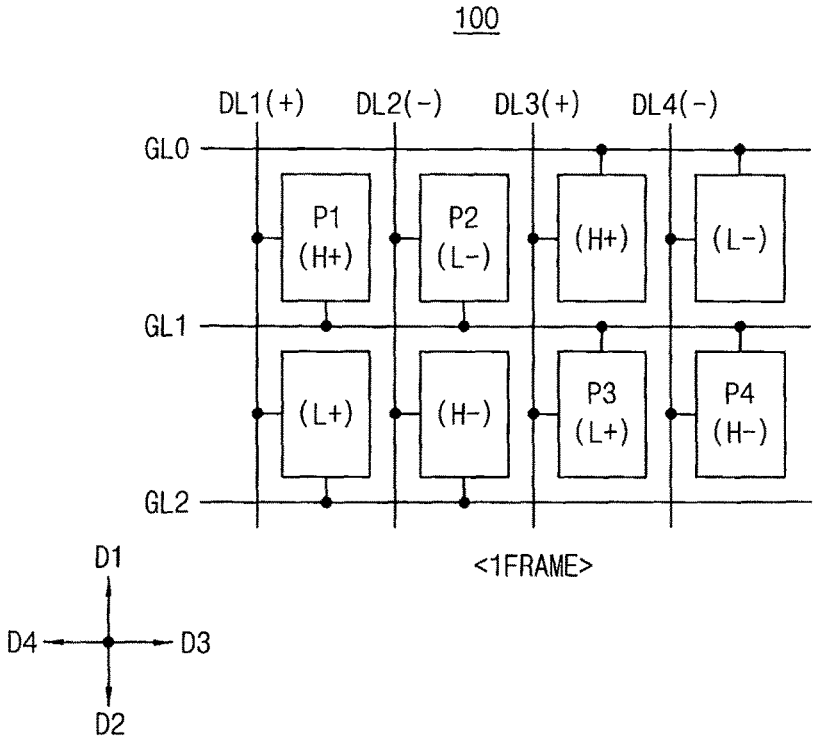
FIGS. 2A and 2B are partial schematic diagrams illustrating a display panel included in a display apparatus according to an exemplary embodiment and examples of data voltages outputted to pixels included in the display panel in first and second frames.
Figure 2B:
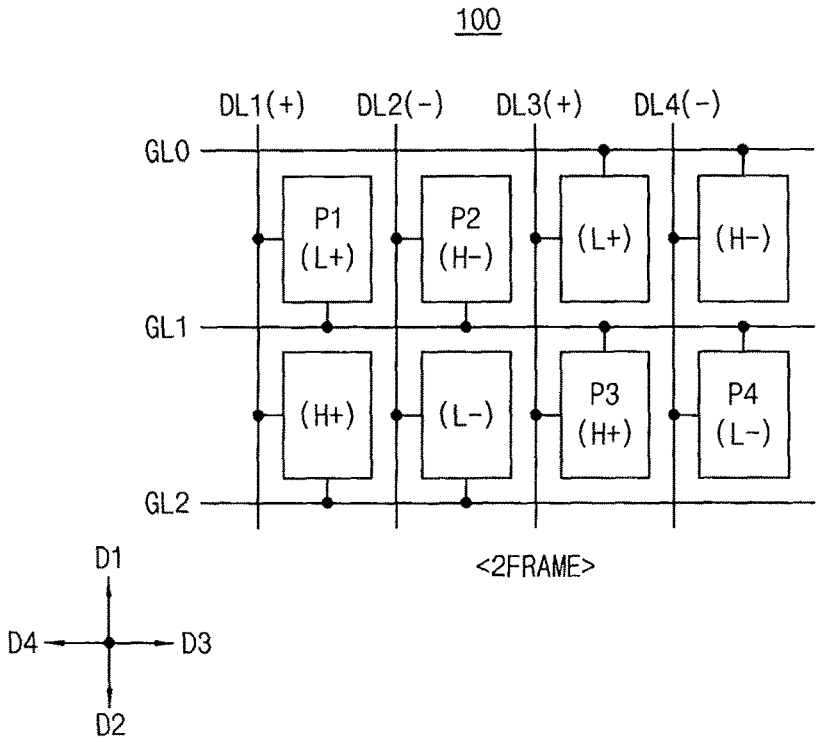

FIGS. 2A and 2B are diagrams illustrating a display panel included in a display apparatus according to an exemplary embodiment and examples of data voltages outputted to pixels included in the display panel in first and second frames.

Referring to FIGS. 1, 2A and 2B, the display panel 100 includes a first gate line GL1 extending in the third direction D3. The display panel 100 may further include an upper gate line GL0 and a second gate line GL2 extending in the third direction D3. The display panel 100 may further include first through fourth data lines DL1, DL2, DL3, DL4 extending in the second direction D2.

The display panel 100 includes first through fourth pixels P1, P2, P3, P4 connected to the first gate line GL1. The first and second pixels P1, P2 are adjacent to the first gate line GL1 in the first direction D1. The third and fourth pixels P3, P4 are adjacent to the first gate line GL1 in the second direction D2. The second pixel P2 may be adjacent to the first pixel P1 in the third direction D3. The fourth pixel P4 may be adjacent to the third pixel P3 in the third direction D3. The first direction D1 may be an upward direction. The second direction D2 may be a downward direction. The third direction D3 may be a rightward direction. The fourth direction D4 may be a leftward direction.

The display panel 100 may further include pixels connected to the upper gate line GL0 and adjacent to the first gate line GL1 in the first direction D1. The display panel 100 may further include pixels connected to the second gate line GL2 and adjacent to the first gate line GL1 in the second direction D2.

The first pixel P1 may be connected to the first data line DLL The second pixel P2 may be connected to the second data line DL2. The third pixel P3 may be connected to the third data line DL3. The fourth pixel P4 may be connected to the fourth data line DL4.

The timing controller 200 generates the data signal DAT based on a first gamma H and a second gamma L. The second gamma L may be different from the first gamma H.

A luminance of an image based on the first gamma H may be equal to or higher than a luminance of an image based on the second gamma L if substantially the same image data DAT is used for both. The luminance of the image based on the first gamma H may be equal to or higher than a luminance of an image based on a reference gamma if substantially the same image data DAT is used for both. The luminance of the image based on the second gamma L may be equal to or lower than the luminance of the image based on the reference gamma if substantially the same image data DAT is used for both.

Alternatively, the luminance of the image based on the first gamma H may be equal to or lower than the luminance of the image based on the second gamma L if substantially the same image data DAT is used for both. The luminance of the image based on the first gamma H may be equal to or lower than the luminance of the image based on the reference gamma if substantially the same image data DAT is used for both. The luminance of the image based on the second gamma L may be equal to or higher than the luminance of the image based on the reference gamma if substantially the same image data DAT is used for both.

The data driver 500 outputs a first data voltage to the first pixel P1 in a first frame 1FRAME of FIG. 2A. The first data voltage is generated based on the first gamma H and has a first polarity "+". The data driver 500 outputs a second data voltage to the second pixel P2 in the first frame 1FRAME. The second data voltage is generated based on the second gamma L and has a second polarity "−" different from the first polarity "+". The data driver 500 outputs a third data voltage to the third pixel P3 in the first frame 1FRAME. The third data voltage is generated based on the second gamma L and has the first polarity "+". The data driver 500 outputs a fourth data voltage to the fourth pixel P4 in the first frame 1FRAME. The fourth data voltage is generated based on the first gamma H and has the second polarity "−". The first polarity "+" may be a positive polarity. The second polarity "−" may be a negative polarity.

The data driver 500 outputs a fifth data voltage to the first pixel P1 in a second frame 2FRAME of FIG. 2B. The fifth data voltage is generated based on the second gamma L and has the first polarity "+". The data driver 500 outputs a sixth data voltage to the second pixel P2 in the second frame 2FRAME. The sixth data voltage is generated based on the first gamma H and has the second polarity "−". The data driver 500 outputs a seventh data voltage to the third pixel P3 in the second frame 2FRAME. The seventh data voltage is generated based on the first gamma H and has the first polarity "+". The data driver 500 outputs an eighth data voltage to the fourth pixel P4 in the second frame 2FRAME. The eighth data voltage is generated based on the second gamma L and has the second polarity "−". The second frame 2FRAME may be subsequent to the first frame 1FRAME.

In an exemplary embodiment, the first and second frames 1FRAME, 2FRAME may be included in one frame set (for example, a first frame set). The display panel 100 may display one output image during the first frame set by combining first and second images displayed during the first and second frames 1FRAME, 2FRAME.

Although not illustrated in FIGS. 1, 2A and 2B, data voltages having the second polarity "−" may be applied to the first and third data lines DL1, DL3 during the third and fourth frames subsequent to the first and second frames 1FRAME, 2FRAME. Data voltages having the first polarity "+" may be applied to the second and fourth data lines DL2, DL4 during the third and fourth frames. The third and fourth frames may be included in one frame set (for example, a second frame set subsequent to the first frame set).

Figure 2C:
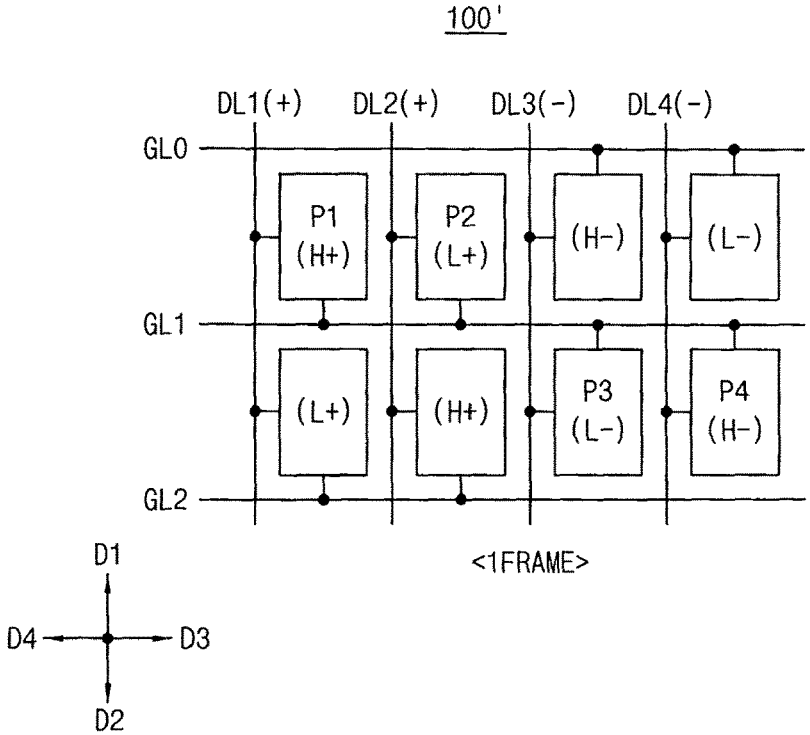
FIGS. 2C and 2D are partial schematic diagrams illustrating a display panel included in a display apparatus according to an exemplary embodiment and examples of data voltages outputted to pixels included in the display panel in first and second frames.
Figure 2D:
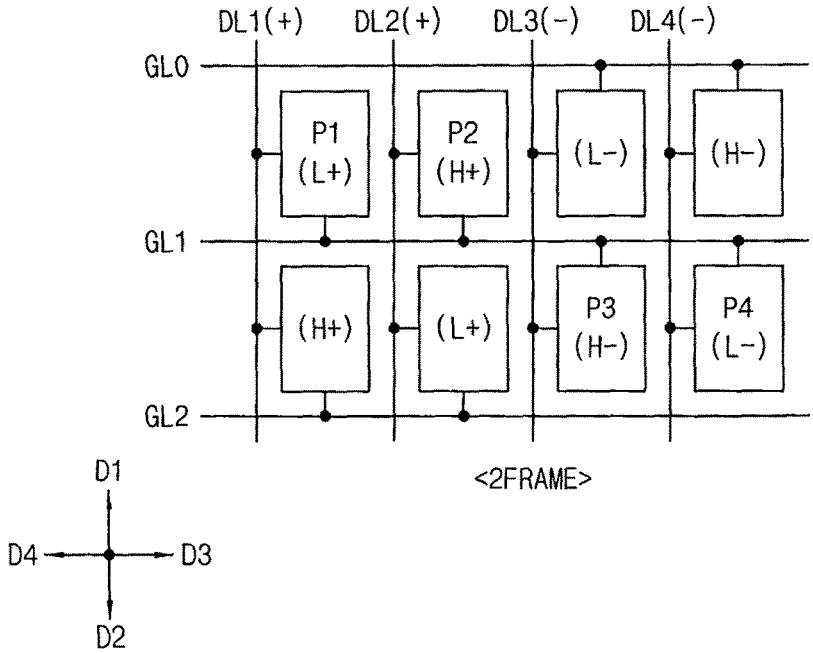

FIGS. 2C and 2D are diagrams illustrating a display panel included in a display apparatus according to an exemplary embodiment and examples of data voltages outputted to pixels included in the display panel in first and second frames. Hereinafter, any repetitive explanation concerning FIGS. 2A and 2B will be omitted.

Referring to FIGS. 1, 2C and 2D, the data driver 500 outputs a first data voltage to the first pixel P1 in a first frame 1FRAME for the display panel 100' of FIG. 2C. The first data voltage is generated based on the first gamma H and has a first polarity "+". The data driver 500 outputs a second data voltage to the second pixel P2 in the first frame 1FRAME. The second data voltage is generated based on the second gamma L and has the first polarity "+". The data driver 500 outputs a third data voltage to the third pixel P3 in the first frame 1FRAME. The third data voltage is generated based on the second gamma L and has a second polarity "−" different from the first polarity "+". The data driver 500 outputs a fourth data voltage to the fourth pixel P4 in the first frame 1FRAME. The fourth data voltage is generated based on the first gamma H and has the second polarity "−". The first polarity "+" may be a positive polarity. The second polarity "−" may be a negative polarity.

The data driver 500 outputs a fifth data voltage to the first pixel P1 in a second frame 2FRAME for the display panel 100' of FIG. 2D. The fifth data voltage is generated based on the second gamma L and has the first polarity "+". The data driver 500 outputs a sixth data voltage to the second pixel P2 in the second frame 2FRAME. The sixth data voltage is generated based on the first gamma H and has the first polarity "+". The data driver 500 outputs a seventh data voltage to the third pixel P3 in the second frame 2FRAME. The seventh data voltage is generated based on the first gamma H and has the second polarity "−". The data driver 500 outputs an eighth data voltage to the fourth pixel P4 in the second frame 2FRAME. The eighth data voltage is generated based on the second gamma L and has the second polarity "−". The second frame 2FRAME may be subsequent to the first frame 1FRAME.

Figure 3A:
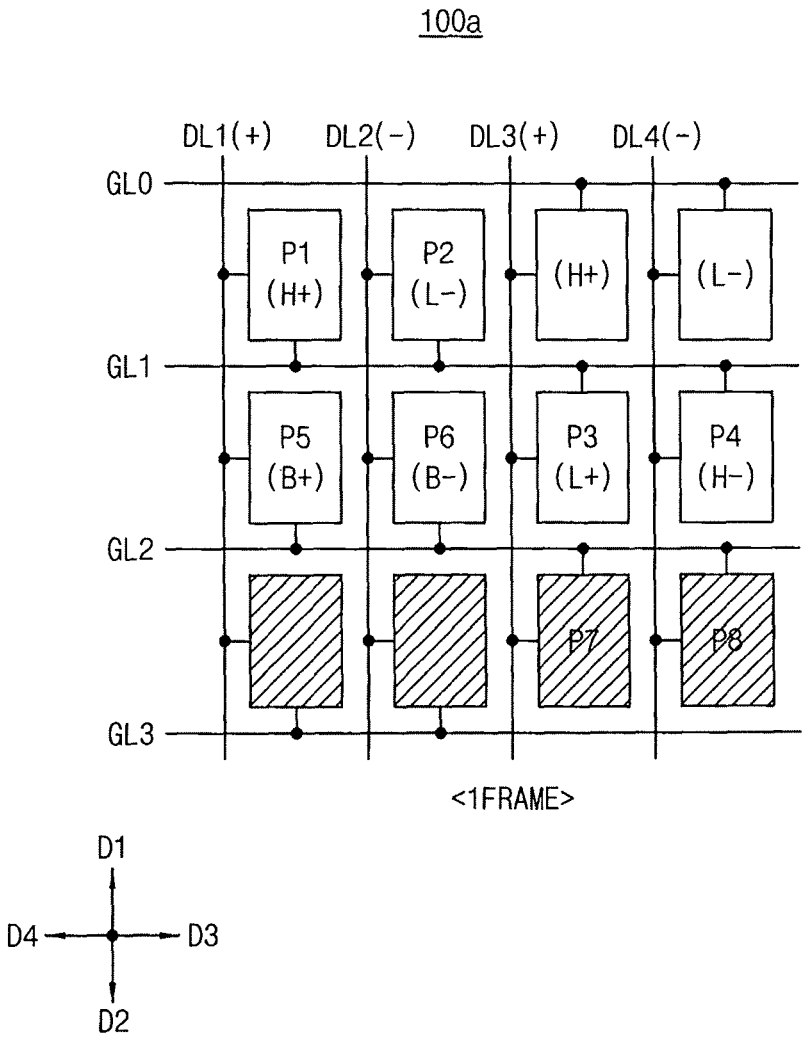
FIGS. 3A and 3B are partial schematic diagrams illustrating a display panel included in a display apparatus according to an exemplary embodiment and examples of data voltages outputted to pixels included in the display panel in first and second frames.
Figure 3B:
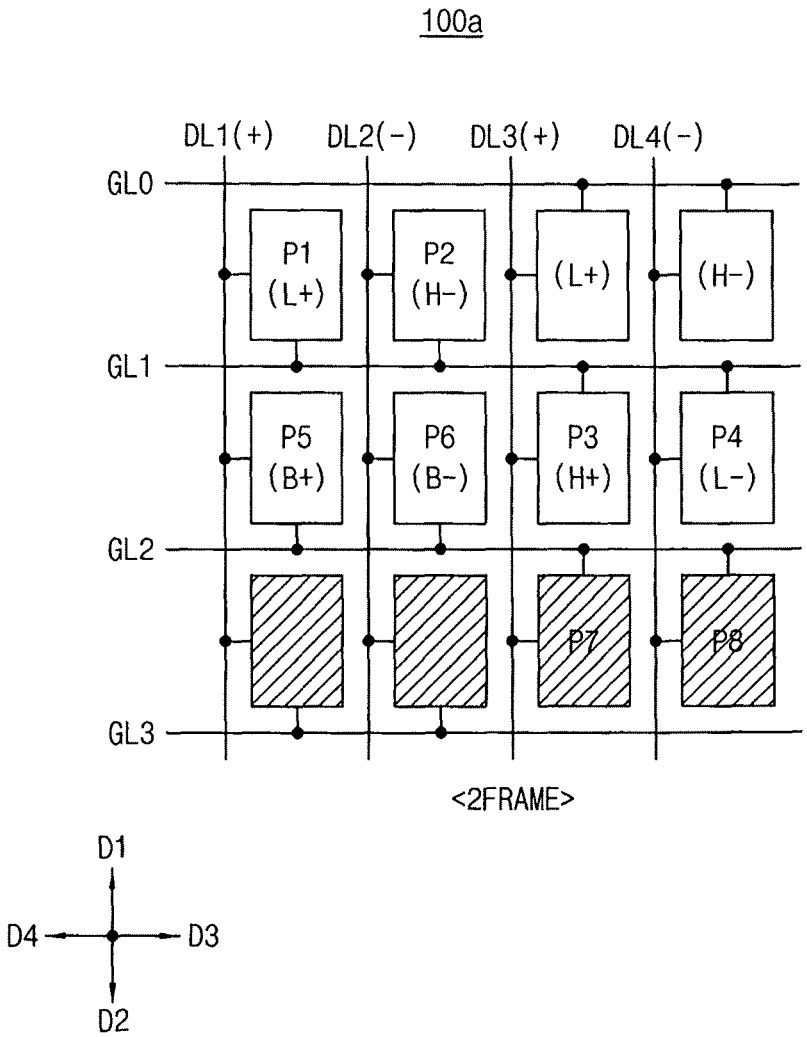

FIGS. 3A and 3B are diagrams illustrating a display panel included in a display apparatus according to an exemplary embodiment and examples of data voltages outputted to pixels included in the display panel in first and second frames.

Referring to FIGS. 1, 3A and 3B, the display panel 100*a* includes a first gate line GL1 extending in the third direction D3. The display panel 100*a* may further include an upper gate line GL0, a second gate line GL2 and a third gate line GL3 extending in the third direction D3. The display panel 100*a* may further include first through fourth data lines DL1, DL2, DL3, DL4 extending in the second direction D2.

The display panel 100*a* includes first through fourth pixels P1, P2, P3, P4 connected to the first gate line GL1. The first and second pixels P1, P2 are adjacent to the first gate line GL1 in the first direction D1. The third and fourth pixels P3, P4 are adjacent to the first gate line GL1 in the second direction D2. The second pixel P2 may be adjacent to the first pixel P1 in the third direction D3. The fourth pixel P4 may be adjacent to the third pixel P3 in the third direction D3. The first direction D1 may be an upward direction. The second direction D2 may be a downward direction. The third direction D3 may be a rightward direction. The fourth direction D4 may be a leftward direction.

The display panel 100*a* may further include fifth through eighth pixels P5, P6, P7, P8 connected to the second gate line GL2. The fifth and sixth pixels P5, P6 may be adjacent to the second gate line GL2 in the first direction D1. The seventh and eighth pixels P7, P8 may be adjacent to the second gate line GL2 in the second direction D2. The sixth pixel P6 may be adjacent to the fifth pixel P5 in the third direction D3. The eighth pixel P8 may be adjacent to the seventh pixel P7 in the third direction D3.

The display panel 100*a* may further include pixels connected to the upper gate line GL0 and adjacent to the first gate line GL1 in the first direction D1. The display panel 100*a* may further include pixels connected to the third gate line GL3 and adjacent to the second gate line GL2 in the second direction D2.

The first and fifth pixels P1, P5 may be connected to the first data line DLL The second and sixth pixels P2, P6 may be connected to the second data line DL2. The third and seventh pixels P3, P7 may be connected to the third data line DL3. The fourth and eighth pixels P4, P8 may be connected to the fourth data line DL4.

The timing controller 200 generates the data signal DAT based on a first gamma H and a second gamma L. The second gamma L may be different from the first gamma H. A luminance of an image based on the first gamma H may be equal to or higher than a luminance of an image based on the second gamma L if substantially the same image data DAT is used for both. The luminance of the image based on the first gamma H may be equal to or higher than a luminance of an image based on a reference gamma if substantially the same image data DAT is used for both. The luminance of the image based on the second gamma L may be equal to or lower than the luminance of the image based on the reference gamma if substantially the same image data DAT is used for both.

Alternatively, the luminance of the image based on the first gamma H may be equal to or lower than the luminance of the image based on the second gamma L if substantially the same image data DAT is used for both. The luminance of the image based on the first gamma H may be equal to or lower than the luminance of the image based on the reference gamma if substantially the same image data DAT is used for both. The luminance of the image based on the second gamma L may be equal to or higher than the luminance of the image based on the reference gamma if substantially the same image data DAT is used for both.

The data driver 500 outputs a first data voltage to the first pixel P1 in a first frame 1FRAME of FIG. 3A. The first data voltage is generated based on the first gamma H and has a first polarity "+". The data driver 500 outputs a second data voltage to the second pixel P2 in the first frame 1FRAME. The second data voltage is generated based on the second gamma L and has a second polarity "−" different from the first polarity "+". The data driver 500 outputs a third data voltage to the third pixel P3 in the first frame 1FRAME. The third data voltage is generated based on the second gamma L and has the first polarity "+". The data driver 500 outputs a fourth data voltage to the fourth pixel P4 in the first frame 1FRAME. The fourth data voltage is generated based on the first gamma H and has the second polarity "−". The first polarity "+" may be a positive polarity. The second polarity "−" may be a negative polarity.

When the fifth and sixth pixels P5, P6 display a first image pattern in the first frame 1FRAME and the seventh and eighth pixels P7, P8 display a second image pattern different from the first image pattern in the first frame 1FRAME, the data driver 500 outputs a fifth data voltage to the fifth pixel P5 in the first frame 1FRAME, and the fifth data voltage is generated based on a reference gamma B and has the first polarity "+", and the data driver 500 outputs a sixth data voltage to the sixth pixel P6 in the first frame 1FRAME, and the sixth data voltage is generated based on the reference gamma B and has the second polarity "−". The second image pattern displayed by the seventh and eighth pixels P7 and P8 may be a black image.

The data driver 500 outputs a seventh data voltage to the first pixel P1 in a second frame 2FRAME of FIG. 3B. The seventh data voltage is generated based on the second gamma L and has a first polarity "+". The data driver 500 outputs an eighth data voltage to the second pixel P2 in the second frame 2FRAME. The eighth data voltage is generated based on the first gamma H and has a second polarity "−". The data driver 500 outputs a ninth data voltage to the third pixel P3 in the second frame 2FRAME. The ninth data voltage is generated based on the first gamma H and has the first polarity "+". The data driver 500 outputs a tenth data voltage to the fourth pixel P4 in the second frame 2FRAME. The tenth data voltage is generated based on the second gamma L and has the second polarity "−".

When the fifth and sixth pixels P5, P6 display a first image pattern in the second frame 2FRAME and the seventh and eighth pixels P7, P8 display a second image pattern different from the first image pattern in the second frame 2FRAME, the data driver 500 outputs an eleventh data voltage to the fifth pixel P5 in the second frame 2FRAME, and the eleventh data voltage is generated based on the reference gamma B and has the first polarity "+", and the data driver 500 outputs a twelfth data voltage to the sixth pixel P6 in the second frame 2FRAME, and the twelfth data voltage is generated based on the reference gamma B and has the second polarity "−". The second image pattern displayed by the seventh and eighth pixels P7 and P8 may be the black image.

Figure 4A:
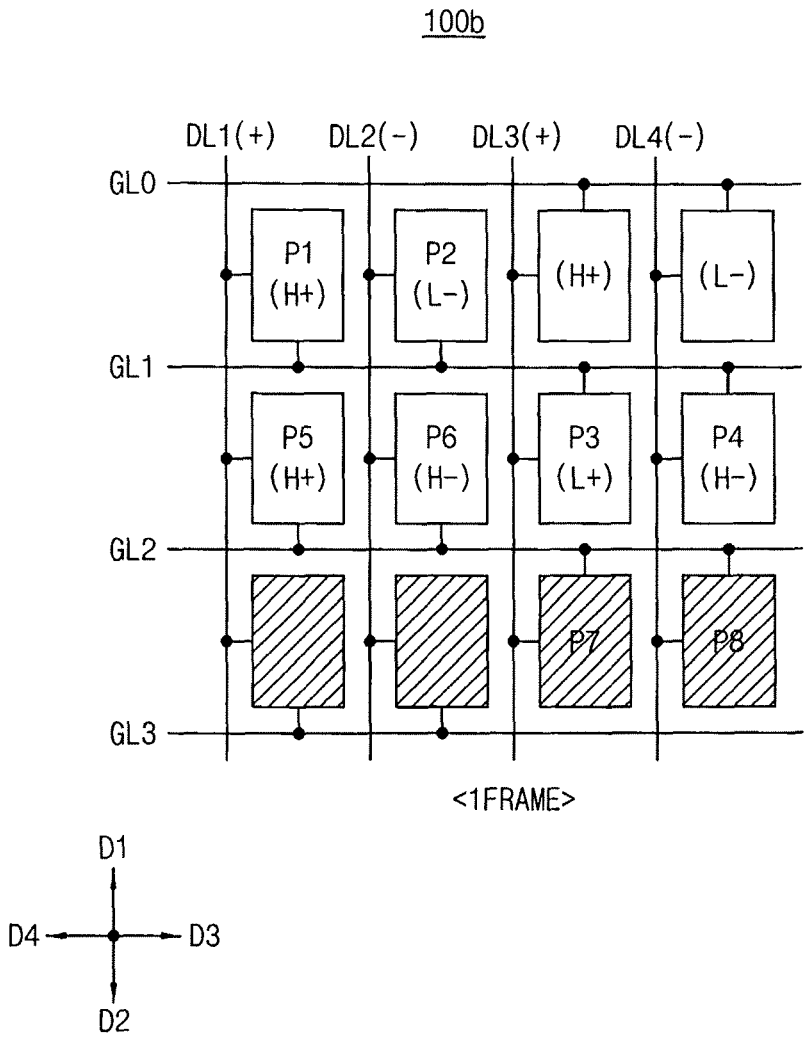
FIGS. 4A and 4B are partial schematic diagrams illustrating a display panel included in a display apparatus according to an exemplary embodiment and examples of data voltages outputted to pixels included in the display panel in first and second frames.
Figure 4B:
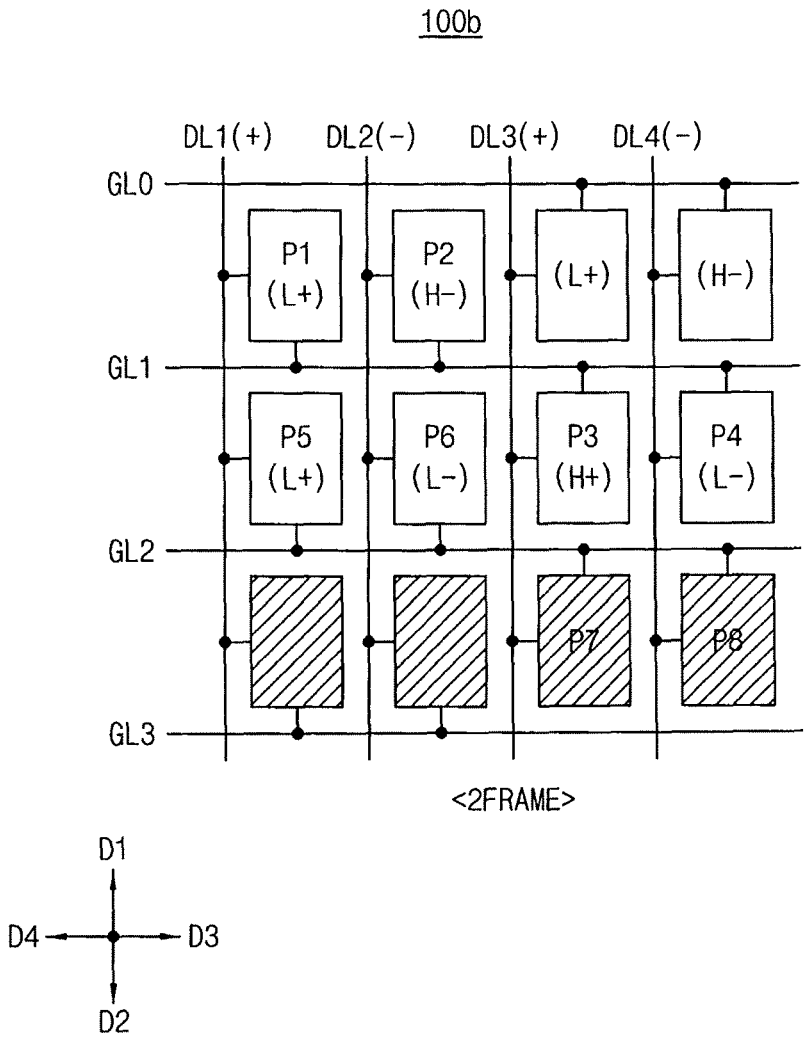

FIGS. 4A and 4B are diagrams illustrating a display panel included in a display apparatus according to an exemplary embodiment and examples of data voltages outputted to pixels included in the display panel 100*b* in first and second frames. Hereinafter, any repetitive explanation concerning FIGS. 3A and 3B will be omitted.

Referring to FIGS. 1, 4A and 4B, when the fifth and sixth pixels P5, P6 display a first image pattern in the first frame 1FRAME of FIG. 4A and the seventh and eighth pixels P7, P8 display a second image pattern different from the first image pattern in the first frame 1FRAME, the data driver 500 outputs a fifth data voltage to the fifth pixel P5 in the first frame 1FRAME, and the fifth data voltage is generated based on a first gamma H and has the first polarity "+", and the data driver 500 outputs a sixth data voltage to the sixth pixel P6 in the first frame 1FRAME, and the sixth data voltage is generated based on the first gamma H and has the second polarity "−". The second image pattern displayed by the seventh and eighth pixels P7 and P8 may be a black image.

When the fifth and sixth pixels P5, P6 display a first image pattern in the second frame 2FRAME of FIG. 4B and the seventh and eighth pixels P7, P8 display a second image pattern different from the first image pattern in the second frame 2FRAME, the data driver 500 outputs an eleventh data voltage to the fifth pixel P5 in the second frame 2FRAME, and the eleventh data voltage is generated based on a second gamma L and has the first polarity "+", and the data driver 500 outputs a twelfth data voltage to the sixth pixel P6 in the second frame 2FRAME, and the twelfth data voltage is generated based on the second gamma L and has the second polarity "−". The second image pattern displayed by the seventh and eighth pixels P7 and P8 may be the black image.

Figure 5A:
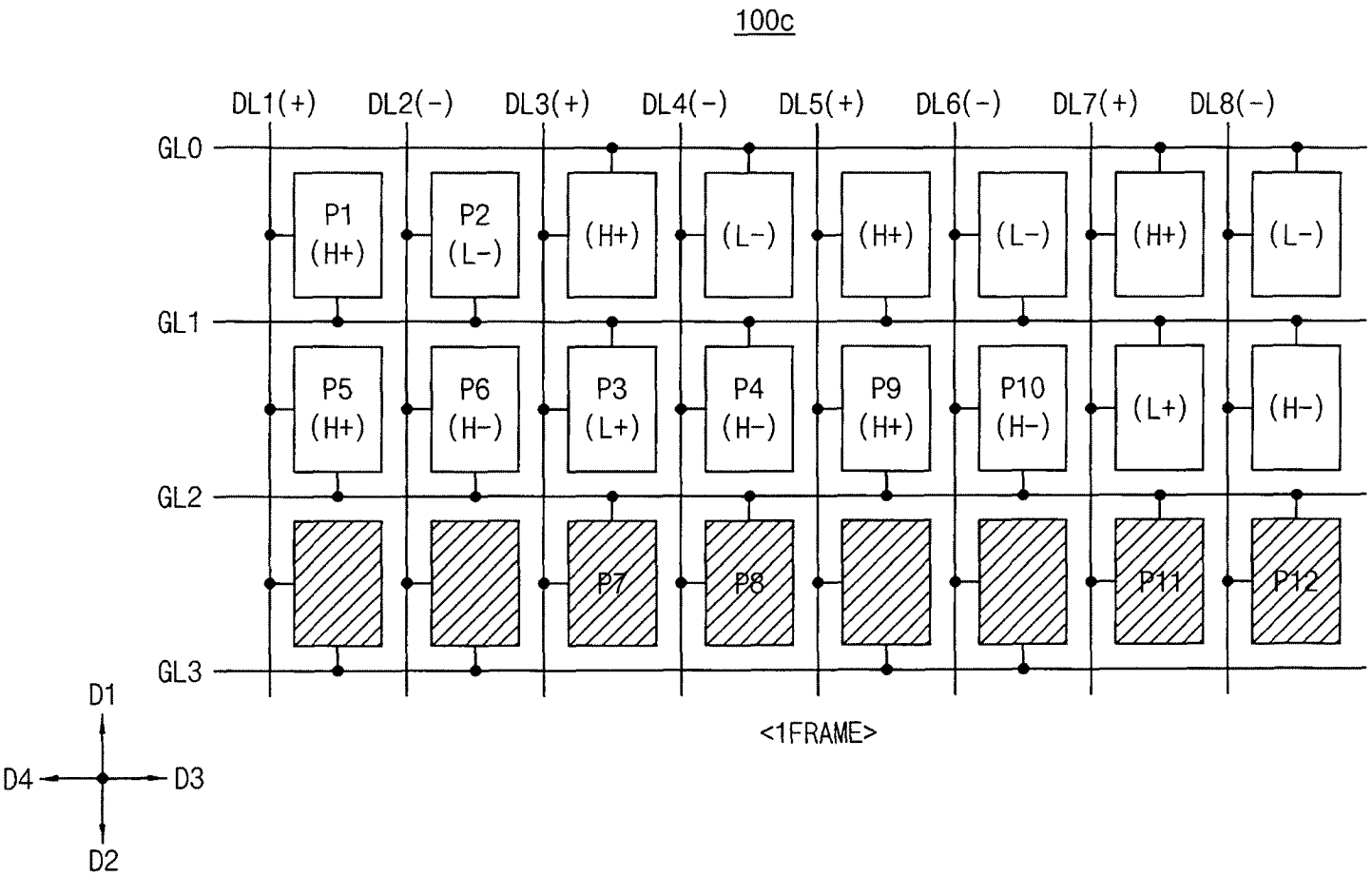
FIGS. 5A and 5B are partial schematic diagrams illustrating a display panel included in a display apparatus according to an exemplary embodiment and examples of data voltages outputted to pixels included in the display panel in first and second frames by a method of FIGS. 4A and 4B.
Figure 5B:
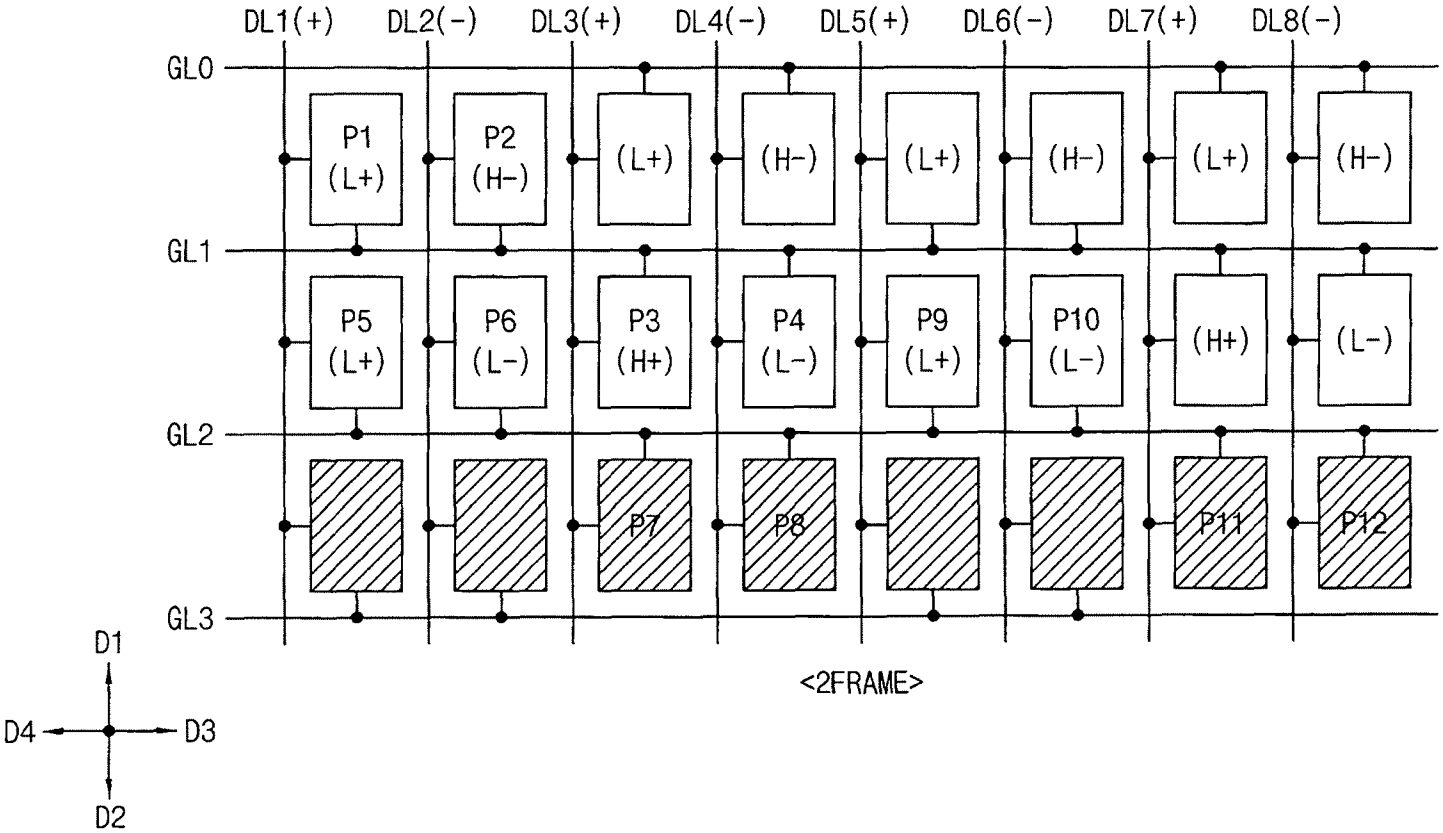

FIGS. 5A and 5B are diagrams illustrating a display panel included in a display apparatus according to an exemplary embodiment and examples of data voltages outputted to pixels included in the display panel in first and second frames by a method of FIGS. 4A and 4B. Hereinafter, any repetitive explanation concerning FIGS. 3A, 3B, 4A and 4B will be omitted.

Referring to FIGS. 1, 5A and 5B, the display panel 100*c* includes a first gate line GL1 extending in the third direction D3. The display panel 100*c* may further include an upper gate line GL0, a second gate line GL2 and a third gate line GL3 extending in the third direction D3. The display panel 100*c* may further include first through eighth data lines DL1, DL2, DL3, DL4, DL5, DL6, DL7, DL8 extending in the second direction D2.

The display panel 100*c* includes first through fourth pixels P1, P2, P3, P4 connected to the first gate line GL1. The first and second pixels P1, P2 are adjacent to the first gate line GL1 in the first direction D1. The third and fourth pixels P3, P4 are adjacent to the first gate line GL1 in the second direction D2. The second pixel P2 may be adjacent to the first pixel P1 in the third direction D3. The fourth pixel P4 may be adjacent to the third pixel P3 in the third direction D3.

The display panel 100*c* may further include fifth through twelfth pixels P5, P6, P7, P8, P9, P10, P11, P12 connected to the second gate line GL2. The fifth, sixth, ninth and tenth pixels P5, P6, P9, P10 may be adjacent to the second gate line GL2 in the first direction D1. The seventh, eighth, eleventh and twelfth pixels P7, P8, P11, P12 may be adjacent to the second gate line GL2 in the second direction D2. The sixth pixel P6 may be adjacent to the fifth pixel P5 in the third direction D3. The eighth pixel P8 may be adjacent to the seventh pixel P7 in the third direction D3. The tenth pixel P10 may be adjacent to the ninth pixel P9 in the third direction D3. The twelfth pixel P12 may be adjacent to the eleventh pixel P11 in the third direction D3.

The display panel 100*c* may further include pixels connected to the upper gate line GL0 and adjacent to the first gate line GL1 in the first direction D1. The display panel 100*c* may further include pixels connected to the first gate line GL1 and adjacent to the first gate line GL1 in the second direction D2. The display panel 100*c* may further include pixels connected to the third gate line GL3 and adjacent to the second gate line GL2 in the second direction D2.

The first and fifth pixels P1, P5 may be connected to the first data line DL1. The second and sixth pixels P2, P6 may be connected to the second data line DL2. The third and seventh pixels P3, P7 may be connected to the third data line DL3. The fourth and eighth pixels P4, P8 may be connected to the fourth data line DL4. The ninth pixel P9 may be connected to the fifth data line DL5. The tenth pixel P10 may be connected to the sixth data line DL6. The eleventh pixel P11 may be connected to the seventh data line DL7. The twelfth pixel P12 may be connected to the eighth data line DL8.

The timing controller 200 generates the data signal DAT based on a first gamma H and a second gamma L. The second gamma L may be different from the first gamma H. A luminance of an image based on the first gamma H may be equal to or higher than a luminance of an image based on the second gamma L if substantially the same image data DAT is used for both. The luminance of the image based on the first gamma H may be equal to or higher than a luminance of an image based on a reference gamma if substantially the same image data DAT is used for both. The luminance of the image based on the second gamma L may be equal to or lower than the luminance of the image based on the reference gamma if substantially the same image data DAT is used for both.

Alternatively, the luminance of the image based on the first gamma H may be equal to or lower than the luminance of the image based on the second gamma L if substantially the same image data DAT is used for both. The luminance of the image based on the first gamma H may be equal to or lower than the luminance of the image based on the reference gamma if substantially the same image data DAT is used for both. The luminance of the image based on the second gamma L may be equal to or higher than the luminance of the image based on the reference gamma if substantially the same image data DAT is used for both.

When the fifth, sixth, ninth and tenth pixels P5, P6, P9, P10 display a first image pattern in the first frame 1FRAME of FIG. 5A and the seventh, eighth, eleventh and twelfth pixels P7, P8, P11, P12 display a second image pattern different from the first image pattern in the first frame 1FRAME, the data driver 500 outputs a fifth data voltage to the fifth pixel P5 in the first frame 1FRAME, and the fifth data voltage is generated based on a first gamma H and has the first polarity "+", and the data driver 500 outputs a sixth data voltage to the sixth pixel P6 in the first frame 1FRAME, and the sixth data voltage is generated based on the first gamma H and has the second polarity "−", and the data driver 500 outputs a seventh data voltage to the ninth pixel P9 in the first frame 1FRAME, and the seventh data voltage is generated based on the first gamma H and has the first polarity "+", and the data driver 500 outputs an eighth data voltage to the tenth pixel P10 in the first frame 1FRAME, and the eighth data voltage is generated based on the first gamma H and has the second polarity "−". The second image pattern displayed by the seventh, eighth, eleventh and twelfth pixels P7, P8, P11 and P12 may be a black image.

When the fifth, sixth, ninth and tenth pixels P5, P6, P9, P10 display a first image pattern in the second frame 2FRAME of FIG. 5B and the seventh, eighth, eleventh and twelfth pixels P7, P8, P11, P12 display a second image pattern different from the first image pattern in the second frame 2FRAME, the data driver 500 outputs a ninth data voltage to the fifth pixel P5 in the second frame 2FRAME, and the ninth data voltage is generated based on a second gamma L and has the first polarity "+", and the data driver 500 outputs a tenth data voltage to the sixth pixel P6 in the second frame 2FRAME, and the tenth data voltage is generated based on the second gamma L and has the second polarity "−", and the data driver 500 outputs a eleventh data voltage to the ninth pixel P9 in the second frame 2FRAME, and the eleventh data voltage is generated based on the second gamma L and has the first polarity "+", and the data driver 500 outputs an twelfth data voltage to the tenth pixel P10 in the second frame 2FRAME, and the twelfth data voltage is generated based on the second gamma L and has the second polarity "−". The second image pattern displayed by the seventh, eighth, eleventh and twelfth pixels P7, P8, P11 and P12 may be the black image.

Figure 6A:
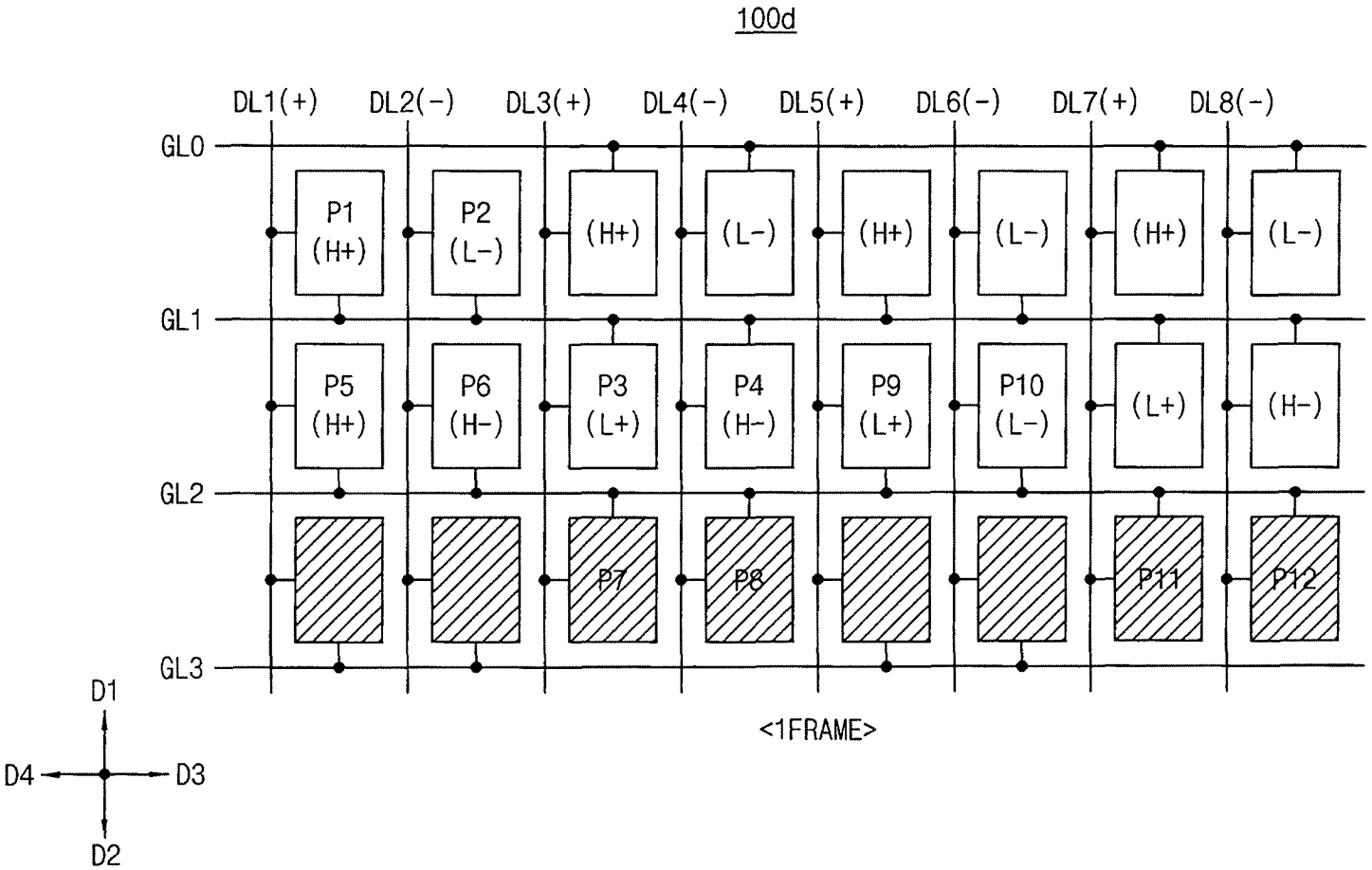
FIGS. 6A and 6B are partial schematic diagrams illustrating a display panel included in a display apparatus according to an exemplary embodiment and examples of data voltages outputted to pixels included in the display panel in first and second frames by a method of FIGS. 4A and 4B.
Figure 6B:
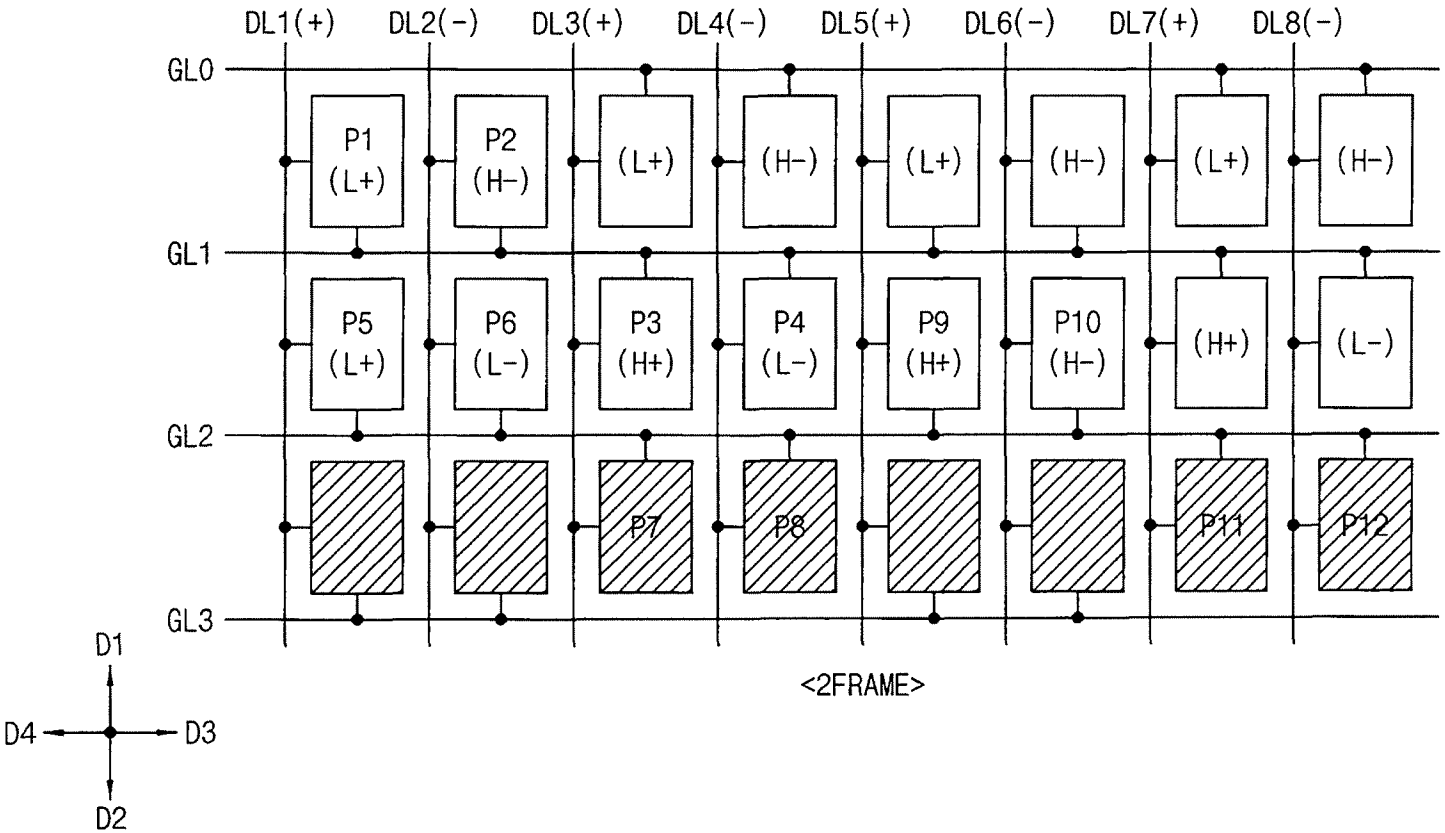

FIGS. 6A and 6B are diagrams illustrating a display panel 100*d* included in a display apparatus according to an exemplary embodiment and examples of data voltages outputted to pixels included in the display panel in first and second frames by a method of FIGS. 4A and 4B. Hereinafter, any repetitive explanation concerning FIGS. 3A, 3B, 4A, 4B, 5A and 5B will be omitted.

Referring to FIGS. 1, 6A and 6B, when the fifth, sixth, ninth and tenth pixels P5, P6, P9, P10 display a first image pattern in the first frame 1FRAME and the seventh, eighth, eleventh and twelfth pixels P7, P8, P11, P12 display a second image pattern different from the first image pattern in the first frame 1FRAME, the data driver 500 outputs a fifth data voltage to the fifth pixel P5 in the first frame 1FRAME, and the fifth data voltage is generated based on a first gamma H and has the first polarity "+", and the data driver 500 outputs a sixth data voltage to the sixth pixel P6 in the first frame 1FRAME, and the sixth data voltage is generated based on the first gamma H and has the second polarity "−", and the data driver 500 outputs a seventh data voltage to the ninth pixel P9 in the first frame 1FRAME, and the seventh data voltage is generated based on a second gamma L and has the first polarity "+", and the data driver 500 outputs an eighth data voltage to the tenth pixel P10 in the first frame 1FRAME, and the eighth data voltage is generated based on the second gamma L and has the second polarity "−". The second image pattern displayed by the seventh, eighth, eleventh and twelfth pixels P7, P8, P11 and P12 may be a black image.

When the fifth, sixth, ninth and tenth pixels P5, P6, P9, P10 display a first image pattern in the second frame 2FRAME and the seventh, eighth, eleventh and twelfth pixels P7, P8, P11, P12 display a second image pattern different from the first image pattern in the second frame 2FRAME, the data driver 500 outputs a ninth data voltage to the fifth pixel P5 in the second frame 2FRAME, and the ninth data voltage is generated based on a second gamma L and has the first polarity "+", and the data driver 500 outputs a tenth data voltage to the sixth pixel P6 in the second frame 2FRAME, and the tenth data voltage is generated based on the second gamma L and has the second polarity "−", and the data driver 500 outputs a eleventh data voltage to the ninth pixel P9 in the second frame 2FRAME, and the eleventh data voltage is generated based on the first gamma H and has the first polarity "+", and the data driver 500 outputs an twelfth data voltage to the tenth pixel P10 in the second frame 2FRAME, and the twelfth data voltage is generated based on the first gamma H and has the second polarity "−". The second image pattern displayed by the seventh, eighth, eleventh and twelfth pixels P7, P8, P11 and P12 may be the black image.

Figure 7A:
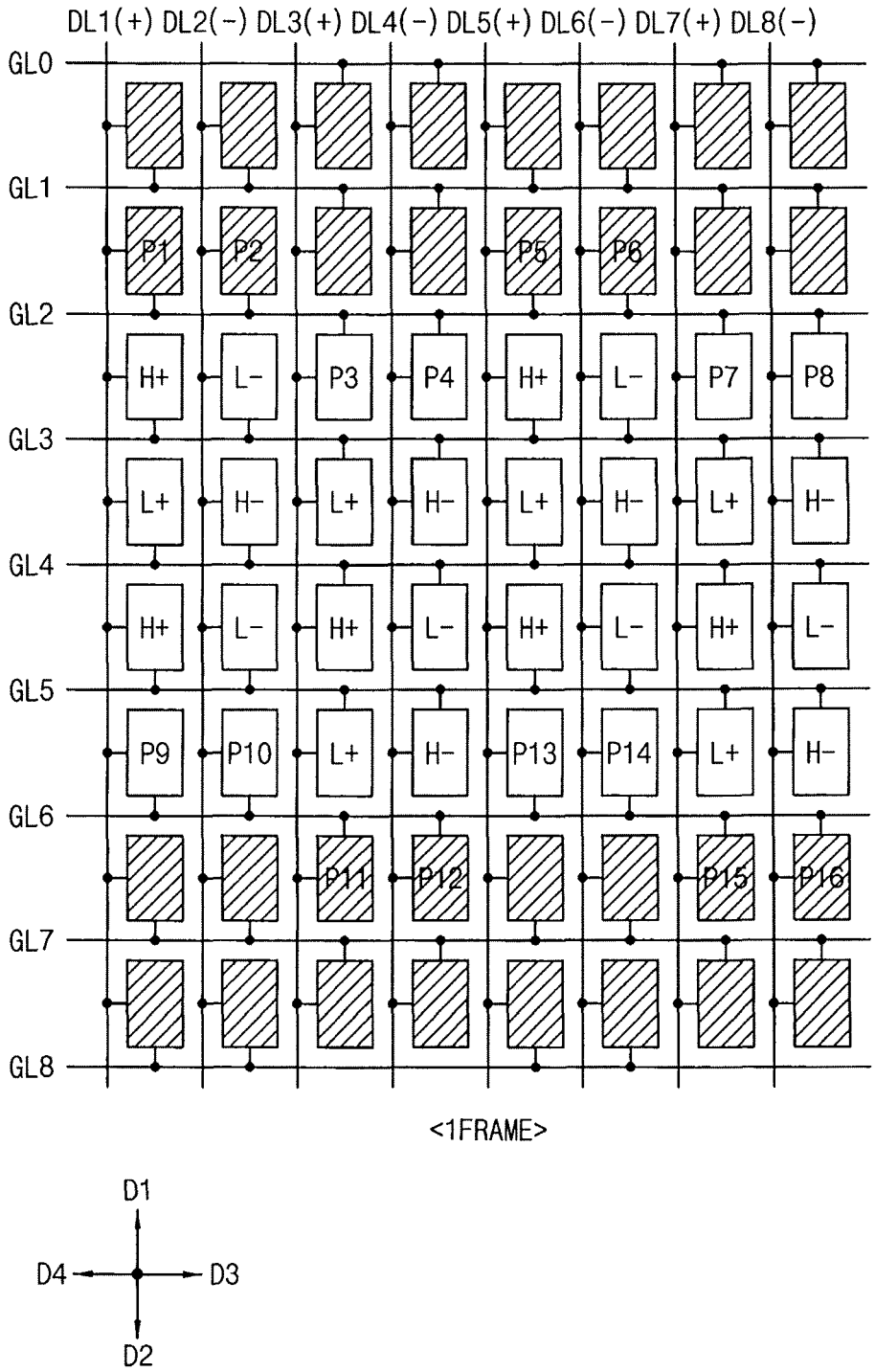
FIGS. 7A and 7B are partial schematic diagrams illustrating a display panel included in a display apparatus according to an exemplary embodiment and examples of data voltages outputted to pixels included in the display panel in first and second frames.
Figure 7B:
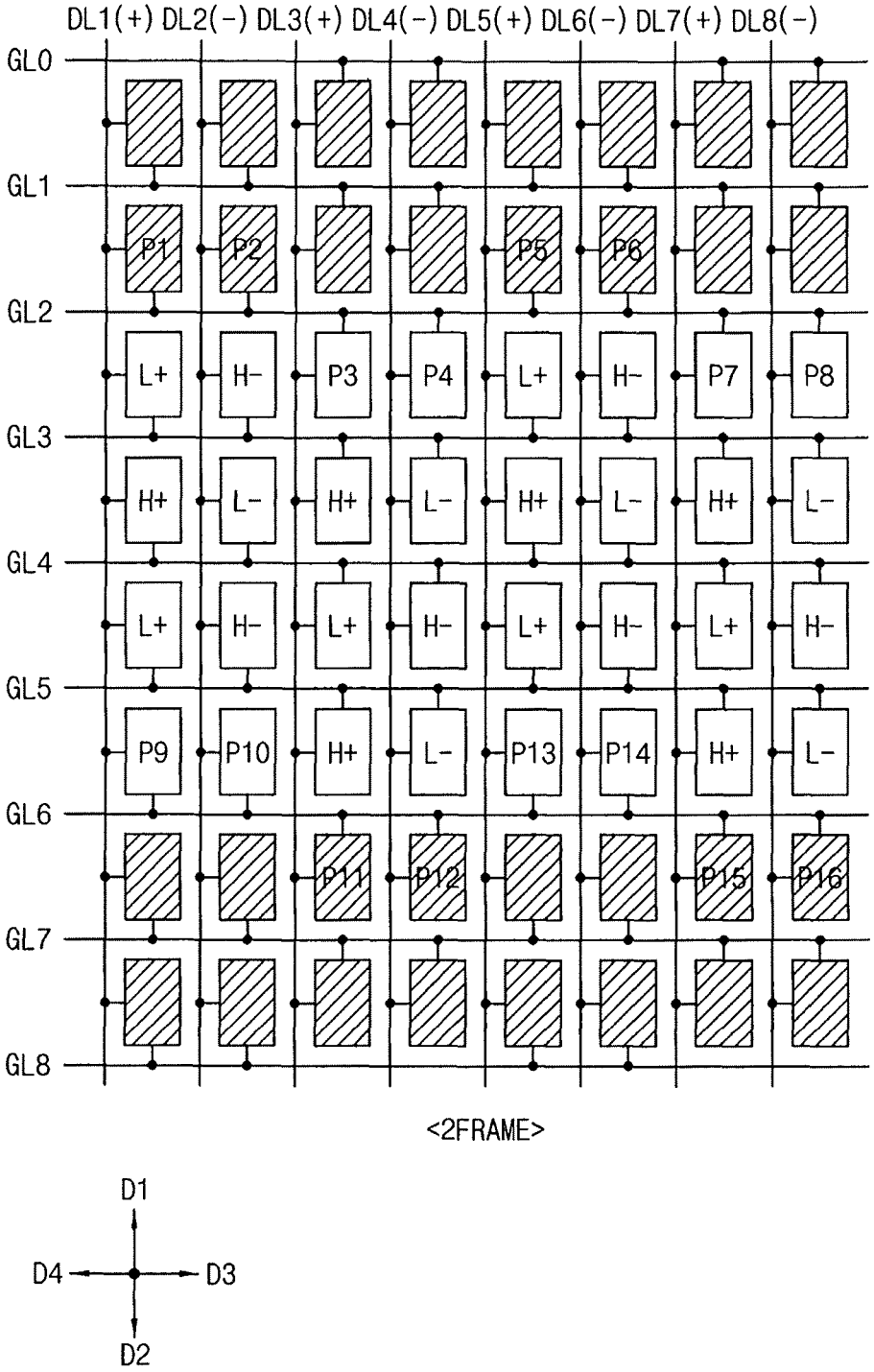

FIGS. 7A and 7B are diagrams illustrating a display panel included in a display apparatus according to an exemplary embodiment and examples of data voltages outputted to pixels included in the display panel in first and second frames.

Referring to FIGS. 7A and 7B, a display panel is driven by a method of a temporal gamma mixing "TGM" that one frame set based on at least two frames and displays an original image during one frame set by combining at least one frame image having a grayscale higher than that of the original image during at least one frame and at least one frame image having a grayscale lower than that of the original image during at least one frame.

The display panel includes an upper gate line GL0 and first through eighth gate lines GL1~GL8 extending in a third direction D3. The display panel includes first through eighth data lines DL1~DL8 extending in a second direction D2 crossing the third direction D3. The display panel includes pixels arranged in an 8 by 8 matrix configuration. The pixels are connected to upper and lower gate lines alternately by two pixels. Each of the pixels may be connected to the data line adjacent to the left side of each pixel.

Data voltages generated based on first, second and reference gammas are outputted to the pixels. A luminance of an image based on the first gamma may be equal to or higher than a luminance of an image based on a reference gamma if substantially the same image data DAT is used for both. A luminance of an image based on the second gamma may be equal to or lower than the luminance of the image based on the reference gamma if substantially the same image data DAT is used for both.

Alternatively, the luminance of the image based on the first gamma may be equal to or lower than the luminance of the image based on the reference gamma if substantially the same image data DAT is used for both. The luminance of the image based on the second gamma may be equal to or higher than the luminance of the image based on the reference gamma if substantially the same image data DAT is used for both.

Pixels disposed on third, fourth, fifth and sixth rows of the matrix display a first image pattern in a first frame 1FRAME of FIG. 7A, and pixels disposed on first, second, seventh and eighth rows of the matrix display a second image pattern in the first frame 1FRAME. The second image pattern of the first, second, seventh and eighth rows may be a black image.

In an exemplary embodiment, data voltages generated based on the reference gamma may be outputted to third, fourth, seventh and eighth pixels in the first frame 1FRAME.

In an exemplary embodiment, data voltages generated based on the first gamma may be outputted to third, fourth, seventh and eighth pixels in the first frame 1FRAME. Alternatively, data voltages generated based on the second gamma may be outputted to the third, fourth, seventh and eighth pixels in the first frame 1FRAME.

In an exemplary embodiment, data voltages generated based on the first gamma may be outputted to third and fourth pixels in the first frame 1FRAME. Data voltages generated based on the second gamma may be outputted to seventh and eighth pixels in the first frame 1FRAME. Alternatively, data voltages generated based on the second gamma may be outputted to the third and fourth pixels in the first frame 1FRAME. Data voltages generated based on the first gamma may be outputted to the seventh and eighth pixels in the first frame 1FRAME.

In an exemplary embodiment, data voltages generated based on the reference gamma may be outputted to ninth, tenth, thirteenth and fourteenth pixels in the first frame 1FRAME.

In an exemplary embodiment, data voltages generated based on the first gamma may be outputted to ninth, tenth, thirteenth and fourteenth pixels in the first frame 1FRAME. Alternatively, data voltages generated based on the second gamma may be outputted to the ninth, tenth, thirteenth and fourteenth pixels in the first frame 1FRAME.

In an exemplary embodiment, data voltages generated based on the first gamma may be outputted to ninth and tenth pixels in the first frame 1FRAME. Data voltages generated based on the second gamma may be outputted to thirteenth and fourteenth pixels in the first frame 1FRAME. Alternatively, data voltages generated based on the second gamma may be outputted to the ninth and tenth pixels in the first frame 1FRAME. Data voltages generated based on the first gamma may be outputted to the thirteenth and fourteenth pixels in the first frame 1FRAME.

Pixels disposed on third, fourth, fifth and sixth rows of the matrix display a first image pattern in a second frame 2FRAME of FIG. 7B, and pixels disposed on first, second, seventh and eighth rows of the matrix display a second image pattern in the second frame 2FRAME. The second image pattern of the first, second, seventh and eighth rows may be the black image. The second frame 2FRAME may be subsequent to the first frame 1FRAME.

In an exemplary embodiment, data voltages generated based on the reference gamma may be outputted to third, fourth, seventh and eighth pixels in the second frame 2FRAME.

In an exemplary embodiment, data voltages generated based on the second gamma may be outputted to third, fourth, seventh and eighth pixels in the second frame 2FRAME. Alternatively, data voltages generated based on the first gamma may be outputted to the third, fourth, seventh and eighth pixels in the second frame 2FRAME.

In an exemplary embodiment, data voltages generated based on the second gamma may be outputted to third and fourth pixels in the second frame 2FRAME. Data voltages generated based on the first gamma may be outputted to seventh and eighth pixels in the second frame 2FRAME. Alternatively, data voltages generated based on the first gamma may be outputted to the third and fourth pixels in the second frame 2FRAME. Data voltages generated based on the second gamma may be outputted to the seventh and eighth pixels in the second frame 2FRAME.

In an exemplary embodiment, data voltages generated based on the reference gamma may be outputted to ninth, tenth, thirteenth and fourteenth pixels in the second frame 2FRAME.

In an exemplary embodiment, data voltages generated based on the second gamma may be outputted to ninth, tenth, thirteenth and fourteenth pixels in the second frame 2FRAME. Alternatively, data voltages generated based on the first gamma may be outputted to the ninth, tenth, thirteenth and fourteenth pixels in the second frame 2FRAME.

In an exemplary embodiment, data voltages generated based on the second gamma may be outputted to ninth and tenth pixels in the second frame 2FRAME. Data voltages generated based on the first gamma may be outputted to thirteenth and fourteenth pixels in the second frame 2FRAME. Alternatively, data voltages generated based on the first gamma may be outputted to the ninth and tenth pixels in the second frame 2FRAME. Data voltages generated based on the second gamma may be outputted to the thirteenth and fourteenth pixels in the second frame 2FRAME.

Although exemplary embodiments have been shown for ease of description in which two gamma are generally used within alternating groups of two pixels each, the present inventive concept is not limited thereto. For example, three or four gamma might be used within alternating groups of three or four pixels each, respectively, without limitation. Moreover, the three or four gamma may average out to an original, whether within a single frame or over a plurality of sub-frames corresponding to a single original frame. These and other embodiments are contemplated within the scope of the present inventive concept.

The above described embodiments may be used in a display apparatus and/or a system including the display apparatus, such as a mobile phone, a smart phone, a PDA, a PMP, a digital camera, a digital television, a set-top box, a music player, a portable game console, a navigation device, a personal computer (PC), a server computer, a workstation, a tablet computer, a laptop computer, a smart card, a printer, or the like.

The foregoing is illustrative of exemplary embodiments and is not to be construed as limiting thereof. Although exemplary embodiments have been described, those of ordinary skill in the pertinent art will readily appreciate that many modifications are possible in the exemplary embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A display apparatus comprising:

a display panel comprising a first gate line, first and second pixels connected to the first gate line and adjacent to the first gate line in a first direction, and third and fourth pixels connected to the first gate line and adjacent to the first gate line in a second direction substantially opposite to the first direction, wherein the first pixel and the second pixel are connected to subsequent consecutive data lines;

a timing controller configured to generate a data signal based on a first gamma and a second gamma different from the first gamma; and a data driver configured to output a first data voltage to the first pixel in a first frame, a second data voltage to the first pixel in a second frame, a third data voltage to the second pixel in the first frame, a fourth data voltage to the third pixel in the first frame, and a fifth data voltage to the fourth pixel in the first frame based on the data signal, the first and fourth data voltages having a first polarity, the third and fifth data voltages having a second polarity different from the first polarity, the first and fifth data voltages being generated based on the first gamma, the second through fourth data voltages being generated based on the second gamma, wherein a luminance of an image based on the first gamma is equal to or higher than a luminance of an image based on the second gamma, wherein the luminance of the image based on the first gamma is equal to or higher than a luminance of an image based on a reference gamma, and the luminance of the image based on the second gamma is equal to or lower than the luminance of the image based on the reference gamma, wherein the display panel further comprises a second gate line, fifth and sixth pixels connected to the second gate line and adjacent to the second gate line in the first direction, and seventh and eighth pixels connected to the second gate line and adjacent to the second gate line in the second direction, and when the fifth and sixth pixels display a first image pattern in the first frame and the seventh and eighth pixels display a second image pattern different from the first image pattern in the first frame, the data signal is configured to be generated based on the first gamma, the second gamma and the reference gamma, and the data driver is configured to output sixth and seventh data voltages to the fifth and sixth pixels respectively in the first frame based on the data signal, the sixth and seventh data voltages being generated based on the reference gamma.

2. The display apparatus of claim 1, wherein the second pixel is adjacent to the first pixel, and the fourth pixel is adjacent to the third pixel.

3. The display apparatus of claim 2, wherein the second pixel is adjacent to the first pixel in a third direction crossing the first and second directions, and the fourth pixel is adjacent to the third pixel in the third direction, and the third pixel is adjacent to the second pixel in the third direction.

4. The display apparatus of claim 1, wherein the data driver is configured to output sixth and seventh data voltages to the second and third pixels respectively in the second frame and eighth data voltage to the fourth pixel in the second frame, the sixth and seventh data voltages being generated based on the first gamma, the eighth data voltage being generated based on the second gamma.

5. A display apparatus comprising:

a display panel comprising a first gate line, first and second pixels connected to the first gate line and adjacent to the first gate line in a first direction, and third and fourth pixels connected to the first gate line and adjacent to the first gate line in a second direction substantially opposite to the first direction, wherein the first pixel and the second pixel are connected to subsequent consecutive data lines;

a timing controller configured to generate a data signal based on a first gamma and a second gamma different from the first gamma; and a data driver configured to output a first data voltage to the first pixel in a first frame, a second data voltage to the first pixel in a second frame a third data voltage to the second pixel in the first frame, a fourth date voltage to the third pixel in the first frame, and a fifth data voltage to the fourth pixel in the first frame based on the data signal, the first and fourth data voltages having a first polarity, the third and fifth data voltages having a second polarity different from the first polarity, the first and fifth data voltages being generated based on the first gamma, the second through fourth data voltages being generated based on the second gamma wherein a luminance of an image based on the first gamma is equal to or higher than a luminance of an image based on the second gamma, wherein the luminance of the image based on the first gamma is equal to or higher than a luminance of an image based on a reference gamma, and the luminance of the image based on the second gamma is equal to or lower than the luminance of the image based on the reference gamma, wherein the display panel further comprises a second gate line, fifth and sixth pixels connected to the second gate line and adjacent to the second gate line in the first direction, and seventh and eighth pixels connected to the second gate line and adjacent to the second gate line in the second direction, and when the fifth and sixth pixels display a first image pattern in the first and second frames and the seventh and eighth pixels display a second image pattern different from the first image pattern in the first and second frames, the data driver is configured to output sixth and seventh data voltages to the fifth and sixth pixels respectively in the first frame and eighth and ninth data voltages to the fifth and sixth pixels respectively in the second frame based on the data signal, the sixth and seventh data voltages being generated based on the first gamma, the eighth and ninth data voltages being generated based on the second gamma.

6. The display apparatus of claim 5, wherein the display panel further comprises ninth and tenth pixels connected to the second gate line and adjacent to the second gate line in the first direction, and eleventh and twelfth pixels connected to the second gate line and adjacent to the second gate line in the second direction, and when the ninth and tenth pixels display the first image pattern in the first frame and the eleventh and twelfth pixels display the second image pattern in the first frame, the data driver is configured to output tenth and eleventh data voltages to the ninth and tenth pixels respectively in the first frame based on the data signal, the tenth and eleventh data voltages being generated based on the first gamma.

7. The display apparatus of claim 5, wherein the display panel further comprises ninth and tenth pixels connected to the second gate line and adjacent to the second gate line in the first direction, and eleventh and twelfth pixels connected to the second gate line and adjacent to the second gate line in the second direction, and when the ninth and tenth pixels display the first image pattern in the first frame and the eleventh and twelfth pixels display the second image pattern in the first frame, the data driver is configured to output tenth and eleventh data voltages to the ninth and tenth pixels respectively in the first frame based on the data signal, the tenth and eleventh data voltages being generated based on the second gamma.

8. A method of driving a display apparatus comprising a display panel comprising a first gate line, first and second pixels connected to the first gate line and adjacent to the first gate line in a first direction, and third and fourth pixels connected to the first gate line and adjacent to the first gate line in a second direction substantially opposite to the first direction, the method comprising:

outputting a first data voltage to the first pixel in a first frame, the first data voltage being generated based on a first gamma and having a first polarity;

outputting a second data voltage to the first pixel in a second frame, the second data voltage being generated based on a second gamma different from the first gamma;

outputting a third data voltage to the second pixel in the first frame, the third data voltage being generated based on the second gamma and having a second polarity different from the first polarity;

outputting a fourth data voltage to the third pixel in the first frame, the fourth data voltage being generated based on the second gamma and having the first polarity;

outputting a fifth data voltage to the fourth pixel in the first frame, the fifth data voltage being generated based on the first gamma and having the second polarity; and outputting sixth and seventh data voltages to a fifth and a sixth pixel respectively in the first frame, the sixth and seventh data voltages being generated based on a reference gamma, wherein a luminance of an image based on the first gamma is equal to or higher than a luminance of an image based on the second gamma, wherein the luminance of the image based on the first gamma is equal to or higher than a luminance of an image based on a reference gamma, and the luminance of the image based on the second gamma is equal to or lower than the luminance of the image based on the reference gamma, wherein the display panel further comprises a second gate line, the fifth and the sixth pixels are connected to the second gate line and adjacent to the second gate line in the first direction, and the display panel further comprises seventh eighth pixels connected to the second gate line and adjacent to the second gate line in the second direction, and when the fifth and sixth pixels display a first image pattern in the first frame and the seventh and eighth pixels display a second image pattern different from the first image pattern in the first frame.

9. The method of claim 8, wherein, the method further comprises:

outputting sixth and seventh data voltages to the fifth and sixth pixels respectively in the first frame, the sixth and seventh data voltages being generated based on the first gamma; and outputting eighth and ninth data voltages to the fifth and sixth pixels respectively in the second frame, the eighth and ninth data voltages being generated based on the second gamma.

10. The method of claim 9, wherein the display panel further comprises ninth and tenth pixels connected to the second gate line and adjacent to the second gate line in the first direction, and eleventh and twelfth pixels connected to the second gate line and adjacent to the second gate line in the second direction, and when the ninth and tenth pixels display the first image pattern in the first frame and the eleventh and twelfth pixels display the second image pattern in the first frame, the method further comprises outputting tenth and eleventh data voltages to the ninth and tenth pixels respectively in the first frame, the tenth and eleventh data voltages being generated based on the first gamma.

11. The method of claim 9, wherein the display panel further comprises ninth and tenth pixels connected to the second gate line and adjacent to the second gate line in the first direction, and eleventh and twelfth pixels connected to the second gate line and adjacent to the second gate line in the second direction, and when the ninth and tenth pixels display the first image pattern in the first frame and the eleventh and twelfth pixels display the second image pattern in the first frame, the method further comprises outputting tenth and eleventh data voltages to the ninth and tenth pixels respectively in the first frame, the tenth and eleventh data voltages being generated based on the second gamma.

12. The method of claim 8, further comprising:

outputting a sixth data voltage to the second pixel in the second frame, the sixth data voltage being generated based on the first gamma;

outputting a seventh data voltage to the third pixel in the second frame, the seventh data voltage being generated based on the first gamma; and outputting an eighth data voltage to the fourth pixel in the second frame, the eighth data voltage being generated based on the second gamma.

* * * * *